US007841545B2

(12) United States Patent
Wang

(10) Patent No.: US 7,841,545 B2
(45) Date of Patent: Nov. 30, 2010

(54) IMPINGEMENT SPRINKLER WITH ADJUSTABLE OUTFLOW ANGLE

(75) Inventor: Hsin-Fa Wang, Chang Hua Hsien (TW)

(73) Assignee: Cheng-An Wang, Lu Kang Town, Chang Hua Hsien (TW)

( * ) Notice: Subject to any disclaimer, the term of this patent is extended or adjusted under 35 U.S.C. 154(b) by 95 days.

(21) Appl. No.: 12/277,301

(22) Filed: Nov. 25, 2008

(65) Prior Publication Data

US 2010/0127098 A1 May 27, 2010

(51) Int. Cl.
*B05B 3/02* (2006.01)

(52) U.S. Cl. ..... 239/230; 239/232; 239/233; 239/502; 239/504

(58) Field of Classification Search ..... 239/230–233, 239/502, 504
See application file for complete search history.

(56) References Cited

U.S. PATENT DOCUMENTS 3,746,259 A * 7/1973 Apri ..... 239/502
4,537,356 A * 8/1985 Lawson ..... 239/230
4,720,045 A * 1/1988 Meyer ..... 239/232
5,031,835 A * 7/1991 Rojas ..... 239/230

* cited by examiner

*Primary Examiner*—Steven J Ganey
(74) *Attorney, Agent, or Firm*—Egbert Law Offices PLLC

(57) ABSTRACT

The present invention provides an impingement sprinkler with adjustable outflow angle. The invention includes a main body, at a lower side of which there is an inflow tube coupling end, and at upper side of which there is an upper frame. An outlet coupling portion is arranged at the lower flange close to the upper frame. A rotating member is arranged onto the upper frame of the main body; and an adjustable outflow head is assembled onto the outlet coupling portion of the main body, allowing the outflow angle to be freely adjusted. It is possible to adjust freely the sprinkling angle with the adjustable outflow head.

3 Claims, 5 Drawing Sheets

IMPINGEMENT SPRINKLER WITH ADJUSTABLE OUTFLOW ANGLE

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to a gardening sprinkler, and more particularly to an innovative impingement sprinkler with an adjustable outflow angle.

2. Description of Related Art Including Information Disclosed Under 37 CFR 1.97 and 37 CFR 1.98.

The commonly used sprinkler for gardening applications (referred to as impingement sprinkler that can rotate automatically during the sprinkling process) mainly comprises a main body, inflow tube, upper frame, rotating member and outflow tube. The outflow tube facing the main body is arranged obliquely upwards, so that the water flow from inflow tube to outflow tube can be sprinkled as a parabolic water column. With the arrangement of rotating member, automatic rotary sprinkling can be achieved for irrigation purpose.

However, the following shortcomings are observed during actual applications:

When a typical sprinkler is used for sprinkling irrigation, the outflow tube with a preset beveling configuration allows the water flow to generate a parabolic sprinkling distance. With the arrangement of rotating member, the water flow could also generate a circular or oriented rotary sprinkling action. Yet, as the outflow tube of typical sprinkler is often designed with a fixed oblique angle, the water flow can only be sprinkled to a preset distance. As a general rule, the entire sprinkler has to be replaced if users intend to spray water to desired parabolic sprinkling distances via the outflow tube with a beveling configuration. In this case, a few types of suchlike outflow tubes have to be manufactured, leading to higher manufacturing cost and possible storage and maintenance problems of sprinklers.

Thus, to overcome the aforementioned problems of the prior art, it would be an advancement in the art to provide an improved structure that can significantly improve efficacy.

Therefore, the inventor has provided the present invention of practicability after deliberate design and evaluation based on years of experience in the production, development and design of related products.

BRIEF SUMMARY OF THE INVENTION

The enhanced efficacy of the present invention is as follows:

In view of the prior art technology that requires replacement of the sprinklers for various sprinkling angles, it is understood that the sprinklers of different specifications have to be manufactured, leading to the waste of replacement time and increase of production cost. The impingement sprinkler of the present invention allows free adjustment of the sprinkling angle with the adjustable outflow head, but also changes the parabolic sprinkling distance, thereby making it unnecessary to replace the sprinklers of different specifications while saving substantially the production cost.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

Figure 1:
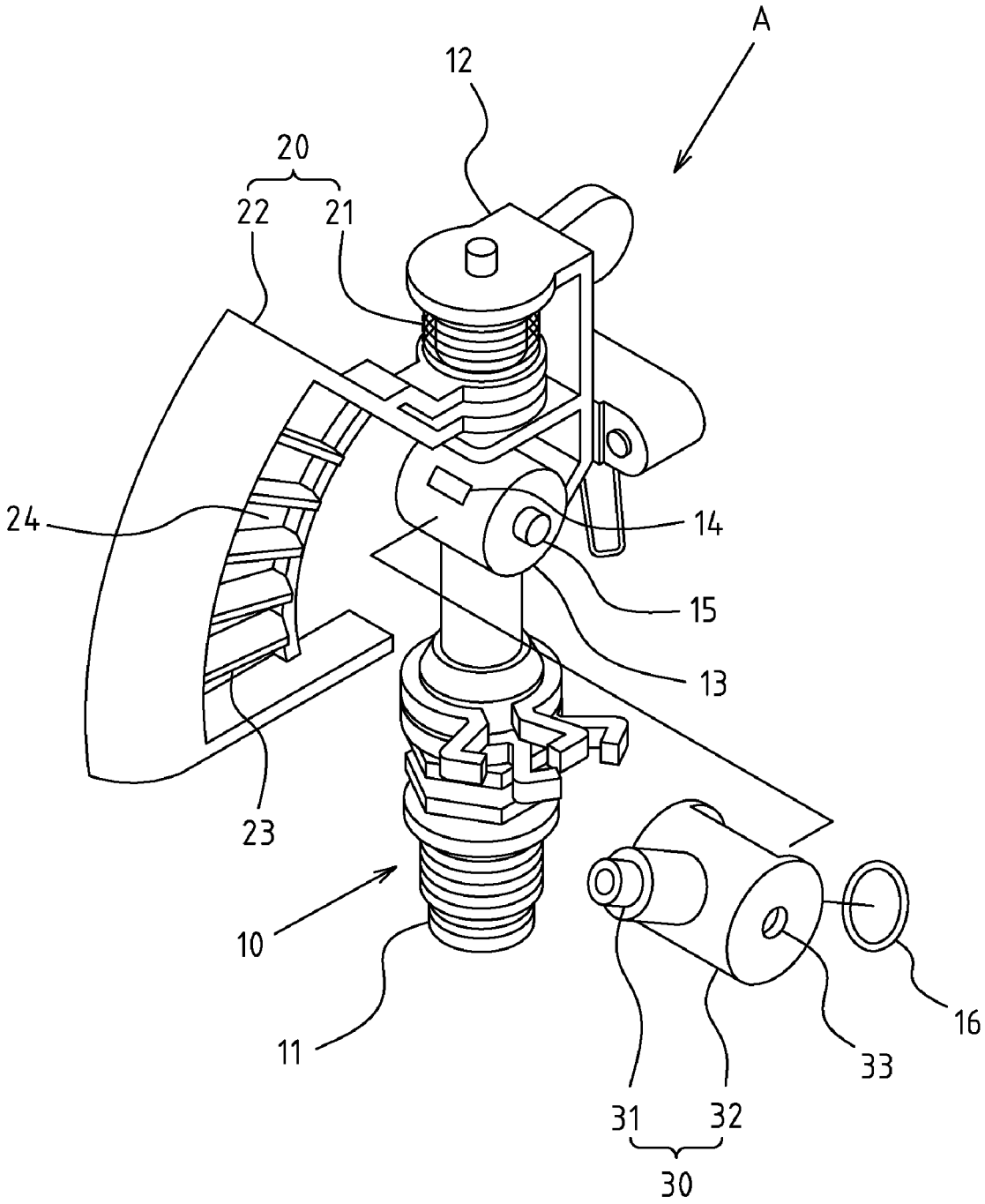
FIG. 1 shows an exploded perspective view of the present invention.
Figure 2:
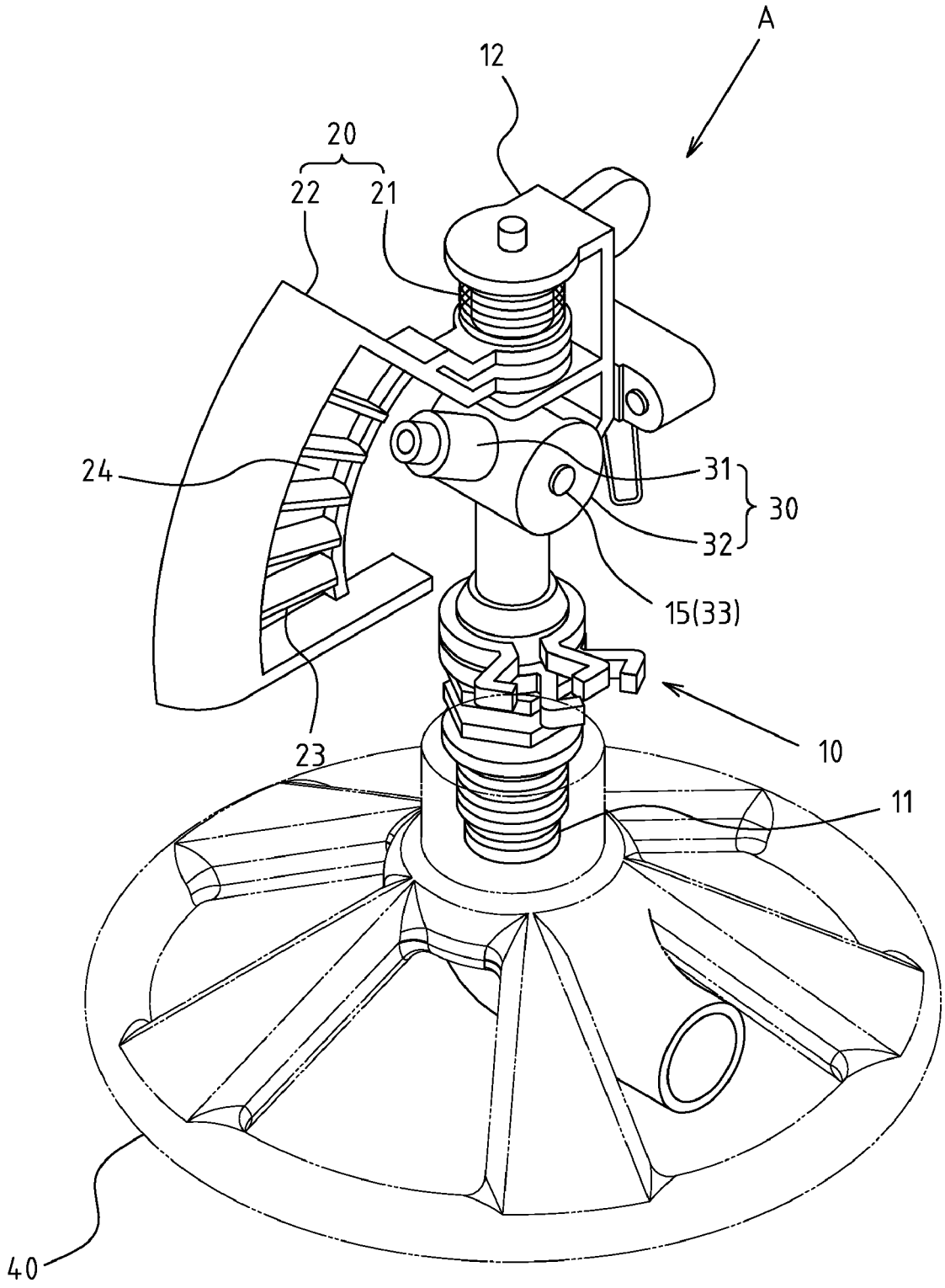
FIG. 2 shows an assembled perspective view of the present invention.
Figure 3:
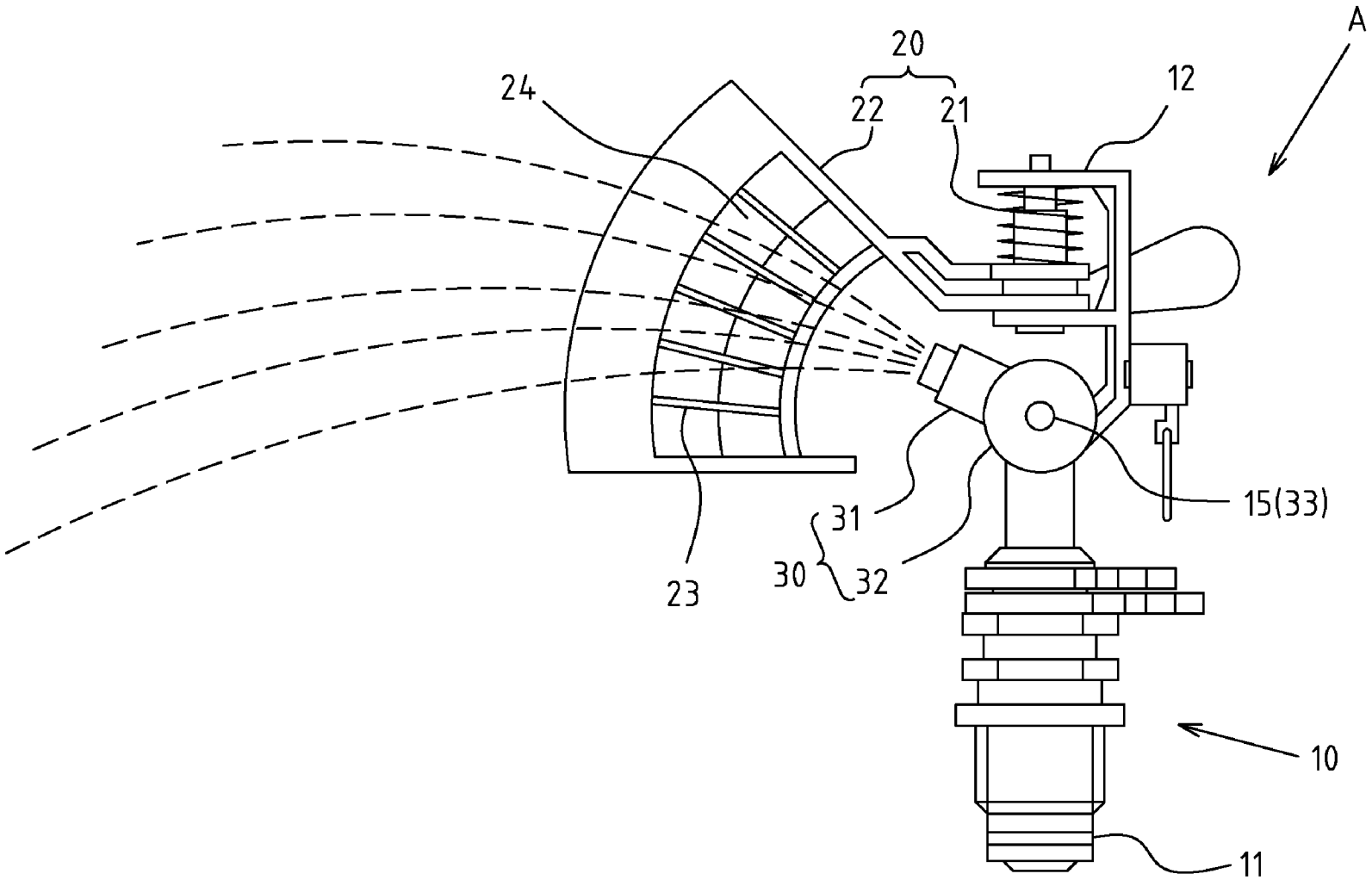
FIG. 3 shows a schematic view of the sprinkling action of the present invention.

The features and the advantages of the present invention will be more readily understood upon a thoughtful deliberation of the following detailed description of a preferred embodiment of the present invention with reference to the accompanying drawings.

FIGS. 1-6 depict a preferred embodiment of impingement sprinkler of the present invention with adjustable outflow angle. The embodiments are only provided for explanatory purposes with respect to the patent claims.

The impingement sprinkler A with adjustable outflow angle comprises a main body 10. At a lower side of which, there is an inflow tube coupling end 11, and at an upper side of which there is an upper frame 12. An outlet coupling portion is arranged at the lower flange close to the upper frame 12. A rotating member 20 is arranged onto the upper frame 12 of the main body 10. An adjustable outflow head 30 is assembled onto the outlet coupling portion 13 of the main body 10, allowing the outflow angle to be adjusted freely.

The rotating member 20 comprises a torsional spring 21 and a rotating portion 22. The rotating portion 22 is arranged in a fan-shaped form, and partitioned into a plurality of outflow channels 24 by a plurality of ribs 23.

The adjustable outflow head 30 is provided with an outflow tube 31 and a rotary coupling portion 32. The rotary coupling portion 32 is fitted with a locating portion 33. The outlet coupling portion 13 of the upper frame 12 contains an outlet 14 and locating bulges 15 at both sides of the outlet coupling portion 13. When the adjustable outflow head 30 is combined with the outlet coupling portion 13, the adjustable outflow head 30 can be rotated freely if the locating portion 33 is snapped onto the locating bulge 15.

At the inner side of the rotary coupling portion 32 of the adjustable outflow head 30, a limit shoulder 34 is arranged for assembly of a stop ring 16, helping to prevent water leakage when the rotary coupling portion 32 is combined with the outlet coupling portion 13.

Figure 4:
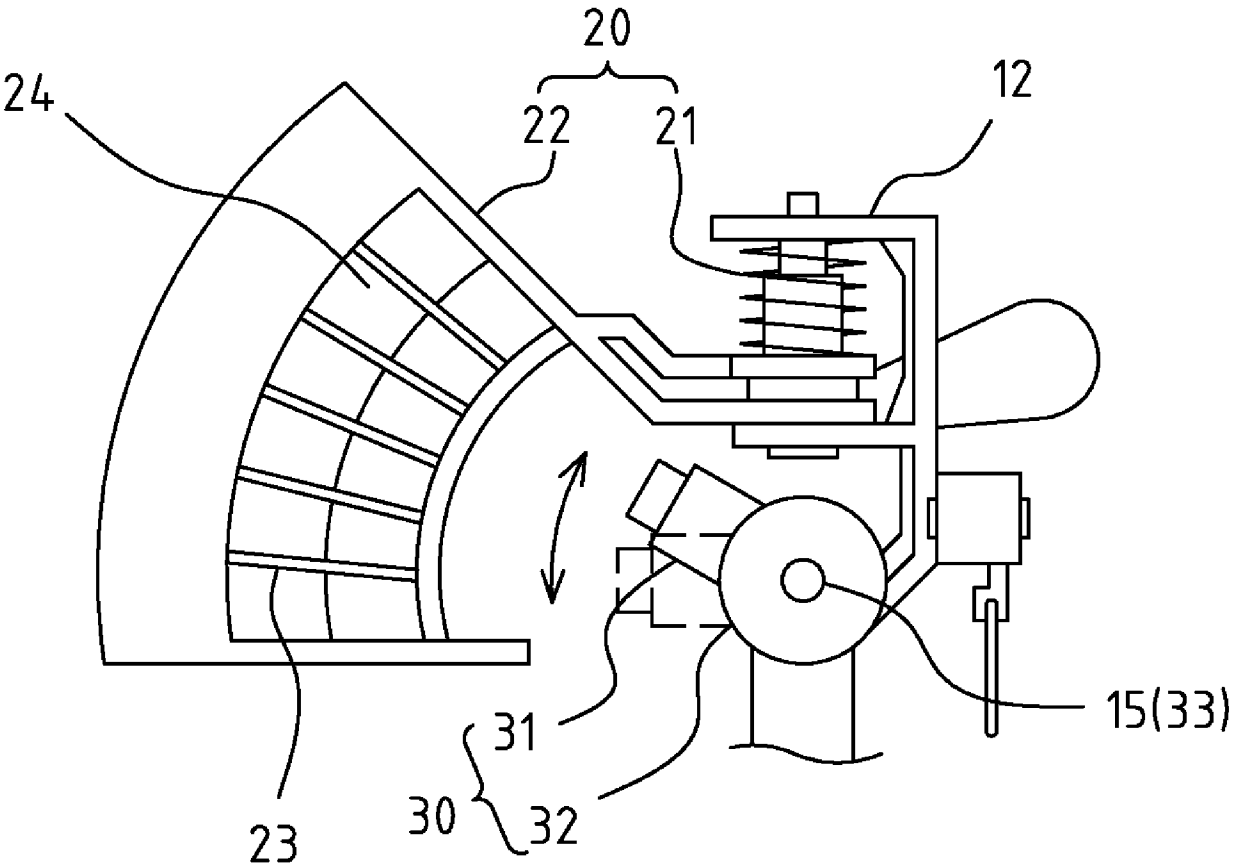
FIG. 4 shows another schematic view of an angular offset of the adjustable outflow head of the present invention.
Figure 6:
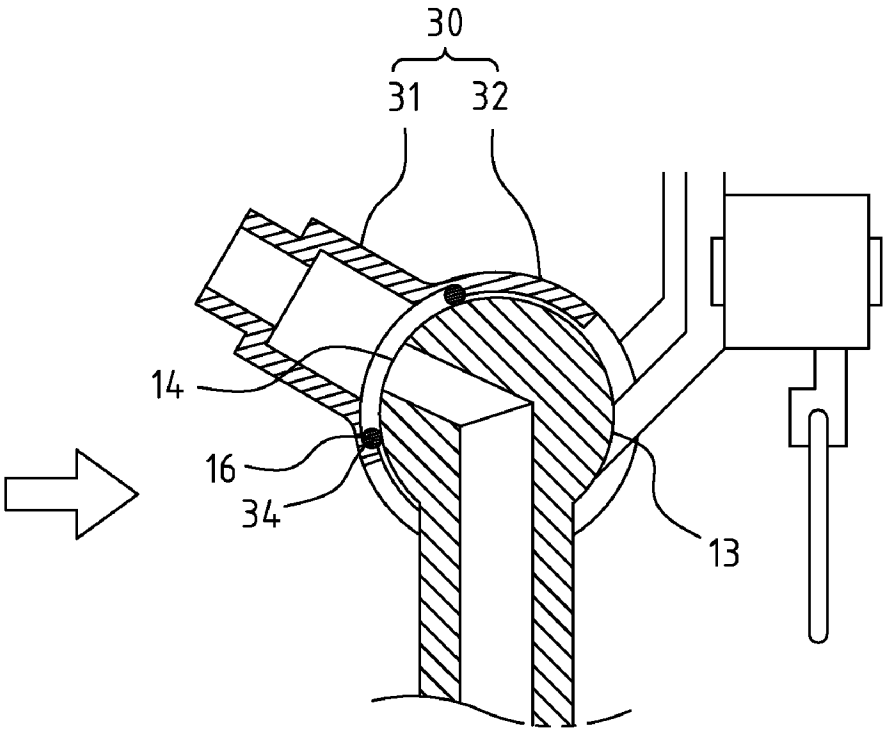
FIG. 6 shows another assembled sectional view of adjustable outflow head of the present invention.
Figure 5:
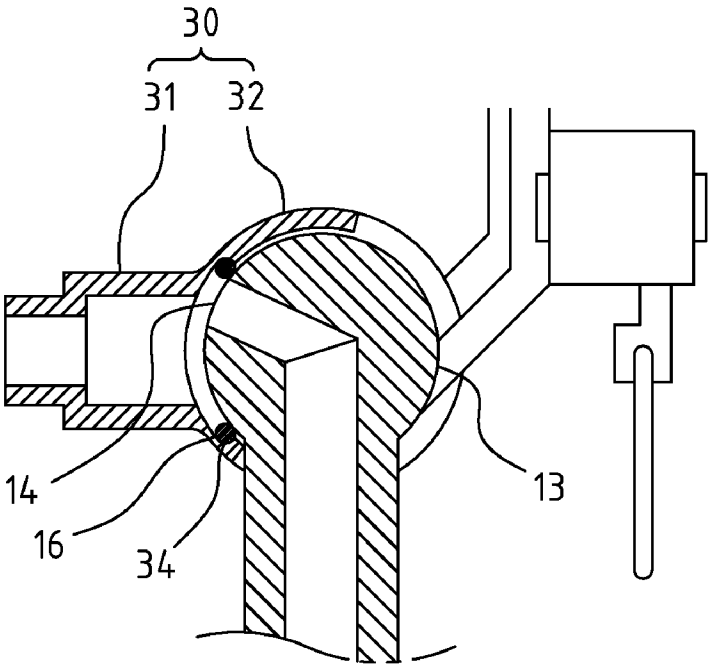
FIG. 5 shows an assembled sectional view of adjustable outflow head of the present invention.

Based on above-specified structures, the present invention is operated as follows:

Referring to FIGS. 4-6, as the adjustable outflow head 30 of the present invention can be adjusted freely. Users are allowed to change the sprinkling angle, and a bigger parabolic sprinkling distance could be realized by reducing the rotating angle of the outflow tube 31 with the help of adjustable outflow head 30. Otherwise, a smaller parabolic sprinkling distance could be realized by increasing the rotating angle of the outflow tube 31. Meanwhile, a plurality of compartmentalized outflow channels 24 formed by the rotating portion 22 is used for diverting properly the water flow.

In practice, the inflow tube coupling end 11 of impingement sprinkler A is assembled onto a sprinkler head 40. When the water flow is fed into the main body 10 through inflow tube coupling end 11 at lower side of the main body 10, and then sprayed from the adjustable outflow head 30 at the outlet coupling portion 13, it is possible for the water flow to impinge the rotating portion 22 of the rotating member 20. So, the rotating portion 22 will offset outwards, and the torsional spring 21 of the rotating member 20 will generate a torsional restoring force, enabling the rotary restoring action of the rotating portion 22. In such a case, the upper frame 12 is impinged. A rotary pivot will be formed when the inflow tube coupling end 11 is combined with the sprinkler head 40. So, the main body 10 will offset to a preset angle when the rotating portion 22 is rotated and reset. Whenever the rotating portion 22 is rotated and reset with water impingement, the main body 10 will thus generate continuously a rotating action, thus enabling offset sprinkling of the impingement sprinkler A.

I claim:

1. A sprinkler apparatus with an adjustable outflow angle, the sprinkler apparatus comprising:

a main body having an inflow tube coupling end at a lower side thereof, said main body having an upper frame at an upper side thereof, said main body having a lower flange adjacent to said upper frame, said lower flange having an outlet coupling portion;

a rotating member positioned onto said upper frame of said main body, said rotating member having a torsional spring and a rotating portion; and an adjustable outflow head assembled onto said outlet coupling portion of said main body so as to allow the outflow angle to be freely adjustable, said adjustable outflow head having an outflow tube and a rotary coupling portion, said rotary coupling portion being fitted with a locating portion, said outlet coupling portion of said upper frame having an outlet, said outlet coupling portion of said upper frame having locating bulges at opposite sides thereof, said adjustable outflow head being freely rotatable when said locating portion is snapped onto the locating bulges.

2. The sprinkler apparatus of claim 1, said rotating portion of said rotating portion of said rotating member having a fan shape, said rotating portion being partitioned into a plurality of outflow channels by a plurality of ribs.

3. The sprinkler apparatus of claim 1, said rotary coupling portion having a limit shoulder at an inner side thereof.

* * * * *